US005087018A

United States Patent [19]

Blase et al.

[11] Patent Number: 5,087,018

[45] Date of Patent: Feb. 11, 1992

[54] FLUID FLOW CONTROL VALVE

[75] Inventors: Michael R. Blase; Henry J. Rosendall; Gordon W. Goodrich, all of Grand Rapids, Mich.

[73] Assignee: Bissell Inc., Grand Rapids, Mich.

[21] Appl. No.: 388,063

[22] Filed: Jul. 31, 1989

Related U.S. Application Data

[60] Continuation of Ser. No. 179,857, Apr. 11, 1988, which is a division of Ser. No. 28,613, Mar. 20, 1987.

[51] Int. Cl.[5] ..... F16K 31/60

[52] U.S. Cl. ..... 251/245; 222/473; 239/526; 239/600; 251/246; 251/322; 251/323

[58] Field of Search ..... 222/373, 472, 473, 474; 239/526, 583, 600; 251/101, 102, 111, 236, 238, 239, 240, 241, 242, 243, 244, 245, 246, 322, 323

[56] References Cited

U.S. PATENT DOCUMENTS

| | | | |
|---|---|---|---|
| 308,186 | 11/1884 | McHugh | 251/246 |
| 523,727 | 7/1894 | Mersereau | 251/240 |
| 2,038,508 | 4/1936 | Elliott | 251/164 |
| 2,195,811 | 4/1940 | Bramsen et al. | 299/150 |
| 2,233,167 | 2/1941 | Holm-Hansen | 15/16 |
| 2,362,946 | 11/1944 | Stockdale | 239/526 |
| 2,403,837 | 7/1946 | Wilson | 251/239 |
| 2,484,232 | 10/1949 | Kochner | 251/239 |
| 2,677,525 | 5/1954 | Pavey et al. | 251/245 |
| 2,731,103 | 1/1956 | Ortega | 183/37 |
| 2,948,351 | 8/1960 | Phillips et al. | 183/2.5 |
| 3,166,777 | 1/1965 | Frantz | 15/323 |
| 3,618,297 | 11/1971 | Hamrick | 55/216 |
| 3,732,667 | 5/1973 | Fromknecht et al. | 55/373 |
| 3,888,421 | 6/1975 | Chow | 239/526 |
| 3,927,834 | 12/1975 | Tada | 239/526 |
| 4,041,567 | 8/1977 | Burgoon | 15/320 |
| 4,061,250 | 12/1977 | Tada | 251/244 |
| 4,083,077 | 4/1978 | Frohbieter | 15/320 |
| 4,083,497 | 4/1978 | Rosenberger | 239/526 |
| 4,098,488 | 7/1978 | Forrest | 251/240 |
| 4,122,579 | 10/1978 | Parise | 15/353 |
| 4,185,354 | 1/1980 | Brazier | 15/321 |
| 4,218,805 | 8/1980 | Brazier | 15/321 |
| 4,245,759 | 1/1981 | Baker et al. | 222/473 |
| 4,287,635 | 9/1981 | Jacobs | 15/321 |
| 4,287,636 | 9/1981 | Brazier | 15/321 |
| 4,333,203 | 6/1982 | Yonkers | 15/320 |
| 4,344,578 | 8/1982 | Shames et al. | 239/283 |
| 4,360,946 | 11/1982 | Marshall, Jr. et al. | 15/321 |
| 4,393,538 | 7/1983 | Olson | 15/320 |
| 4,458,377 | 7/1984 | Frohbieter | 15/320 |
| 4,534,512 | 8/1985 | Chow et al. | 251/111 |
| 4,547,206 | 10/1985 | Sovis et al. | 55/255 |
| 4,619,403 | 10/1986 | Goldney et al. | 239/526 |
| 4,776,517 | 10/1988 | Heren | 239/526 |

FOREIGN PATENT DOCUMENTS

| | | |
|---|---|---|
| 1948941 | 5/1970 | Fed. Rep. of Germany . |
| 54144039 | 10/1985 | Japan . |
| 537426 | 6/1941 | United Kingdom . |
| 661636 | 11/1951 | United Kingdom . |

OTHER PUBLICATIONS

"Now Appliances", *Popular Science*, Jun. 1941.

*Primary Examiner*—George L. Walton
*Attorney, Agent, or Firm*—Price, Heneveld, Cooper, DeWitt & Litton

[57] ABSTRACT

A fluid flow control valve according to the invention includes a base, a valve member, a trigger member and attachment means for attaching the trigger member to the valve member. The base includes a generally horizontal throat and a flange having an upwardly facing surface. The valve member has a stem, a flow level establishing member associated with the stem and biasing means for biasing the stem in a direction opposite to that in which the throat extends. The trigger member includes a pin configured to rotate against an inner end portion of the throat, a flange having a downwardly facing surface and an actuating portion. The biasing means acts in a direction through the attachment means to pull the actuating portion downwardly such that the flanges engage in order to retain the pin in the throat. In this manner, the valve may be assembled without the use of fasteners.

8 Claims, 3 Drawing Sheets

FLUID FLOW CONTROL VALVE

This is a continuation of application Ser. No. 07/179,857, filed Apr. 11, 1988, still pending, which in turn was a division of Ser. No. 07/028,613, filed Mar. 20, 1987, also still pending.

BACKGROUND OF THE INVENTION

This invention relates to surface cleaning apparatus and in particular to such apparatus of the type that utilizes a liquid to clean a carpet or like surface. A typical fluid extraction surface cleaning apparatus has a container for holding a cleaning liquid, such as a diluted detergent, a pump to dispense the liquid onto the surface and a brush, or other means to work the liquid on the surface to remove the dirt. A powerful suction device picks up the liquid through a nozzle and deposits it in a recovery tank.

Such devices have only attained limited use because the above described components have been costly to manufacture and have resulted in a large, heavy package. This bulky package has made such devices difficult to set up and operate and messy to empty of spent fluid and clean up after use. Further, they require a chemical defoamant be put in the recovery tank to prevent the suction from rendering the spent cleaning liquid into objectional foam in the liquid recovery tank.

Further, even when chemical defoamants are used in the detergent solutions or in the recovery tank itself, foam buildup in the recovery tank is a problem. Foam buildup prematurely closes the float valve typically used in such devices to prevent water from entering the suction fan.

SUMMARY OF THE INVENTION

A fluid flow control valve according to the invention includes a base, a valve member, a trigger member and attachment means for attaching the trigger member to the valve member. The base includes a generally horizontal throat and a flange having an upwardly facing surface. The valve member has a stem, a flow level establishing member associated with the stem and biasing means for biasing the stem in a direction opposite to that in which the throat extends. The trigger member includes a pin configured to rotate against an inner end portion of the throat, a flange having a downwardly facing surface and an actuating portion. The biasing means acts in a direction through the attachment means to pull the actuating portion downwardly such that the flanges engage in order to retain the pin throat. In this manner, the valve may be assembled without the use of fasteners.

These and other objects, advantages and features of the invention will be more fully understood and appreciated by reference to the written specification and appended drawings.

DESCRIPTION OF THE PREFERRED EMBODIMENT

A. General Description

Figure 1:
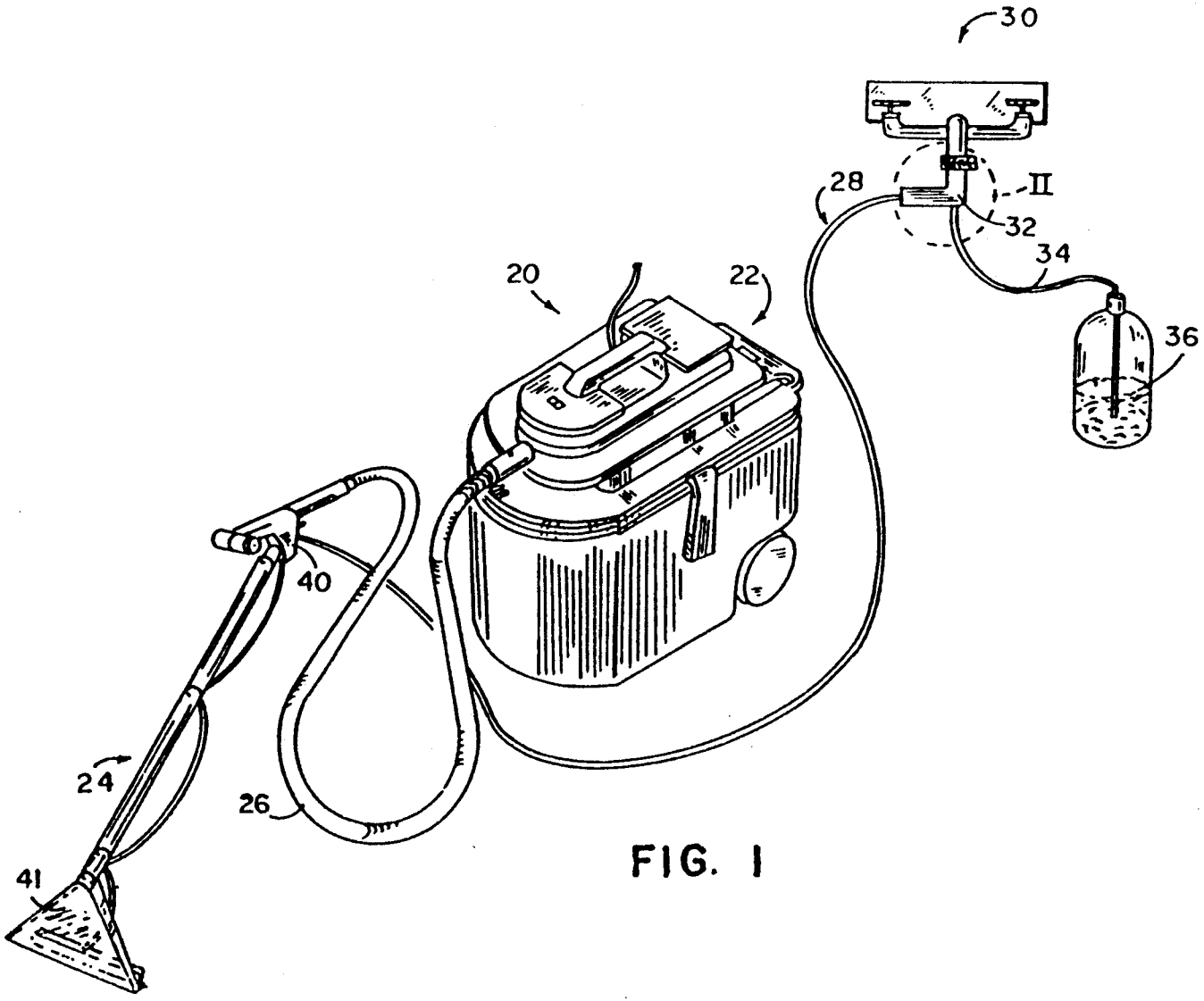
FIG. 1 is a perspective view of a liquid extraction surface cleaning apparatus according to the invention.

Referring now specifically to the drawings, and the illustrative embodiments depicted therein, a liquid extraction surface cleaning apparatus 20 is shown in FIG. 1 fully assembled and ready for use. Cleaning apparatus 20 includes a canister assembly 22 having a suction fan 92 and motor 94 mounted over a recovery tank 72, a wand assembly 24 having a dispensing and pickup head 41 for contacting the surface to be cleaned, a vacuum hose 26 connected between the wand assembly and the canister assembly, and a fluid hose 28 connected between the wand assembly and a faucet, shown at 30.

A vacuum hose 26 connects the wand assembly 24 to a water and air separator 142 which has an arcuate surface transverse to the flow path of the air and spent liquid, to gently separate them into separate streams by diverting the cleaning liquid laterally away from the stream of air. A shutoff valve 117 for preventing recovered liquid in the tank from entering suction fan 92 is mounted in recovery tank 72 rather than to the suction inlet of fan 92. As a result, the dirty spent fluid that tends to cover such a valve will stay in tank 72 when the cover 74 is removed to empty the tank, rather than drip onto the floor as with prior devices.

To reduce weight tank 72 is made of a lightweight plastic material Such a tank, particularly one having planar opposing sidewall members, tends to easily distort out of shape, especially when lifted by the sidewalls and when filled with liquid. To impart internal strength to tank 72, while providing a convenient means for emptying tank 72 of spent liquid, the invention advantageously has a handle member 124 that spans the opposing sidewalls and serves to both strengthen the walls and provide a handle for lifting the tank for emptying. In the preferred embodiment, handle member 124 is rotatably mounted between a use position in which it extends above the tank opening and a storage position in which it is completely concealed within the tank during the cleaning process.

The canister top cover 74 has first and second concentric spools 150 and 152 for wound storage of the power cord and the fluid hose, respectively. During the cleaning process, the apparatus is connected to a faucet which may be located a great distance from the surface to be cleaned. It is, therefore, necessary to provide the apparatus with a lengthy fluid hose 28. Both ends of the hose must be accessible in order to operate the apparatus. However, it is not always necessary to unwind the entire fluid hose. For instance, in order to clean a surface close to a faucet it would be convenient to leave most of the fluid hose wound on the second spool 152. To allow the user to selectively access both ends of the hose while allowing the hose to be partially stored on its spool, spool 152 is provided with means to facilitate such selective access.

The user-operable liquid dispensing control valve assembly 174 on wand 24 includes valve 190 activated by trigger 186. Valve stem 206 longitudinally reciprocates in valve 190 between an open and closed position and is biased to the closed position. Trigger 186 has a laterally oriented pin 228 that is pivotally received within a throat 214 on a base 188 attached to wand 24. A pair of opposing, interlocking flanges 222 and 234 on the base and trigger member cooperate with the attachment means and the pin to keep the trigger assembled to the base and to provide a rugged, smooth-operating mechanism. The control valve is almost entirely plastic and can be assembled without fasteners. However, once assembled, it cannot be accidentally disassembled.

Fluid hose 28 has a hookup member 32 at one end for connection to faucet 30. A suction tube 34 extends from hookup member 32 into a detergent bottle 36 that may be placed in a sink associated with faucet 30. Hose 28 is connected to hookup member 32 at one end and to a fluid control valve 40 on wand assembly 24 at the opposite end.

To clean a surface, water from faucet 30 is fed to the wand assembly through hose 28. Operation of control valve 40 causes water to flow through hookup member 32, creating a suction in tube 34 that draws detergent from bottle 36, which is added in proper proportion to the stream of water flowing through hose 28. The liquid solution of water and detergent is dispensed from spray nozzle 42 mounted on head 41 onto the surface to be cleaned. A brush member 44 on head 41 works the dispensed liquid on the surface to loosen any dirt and to place the dirt into suspension in the liquid.

B. Control Valve and Handle

Figure 2:
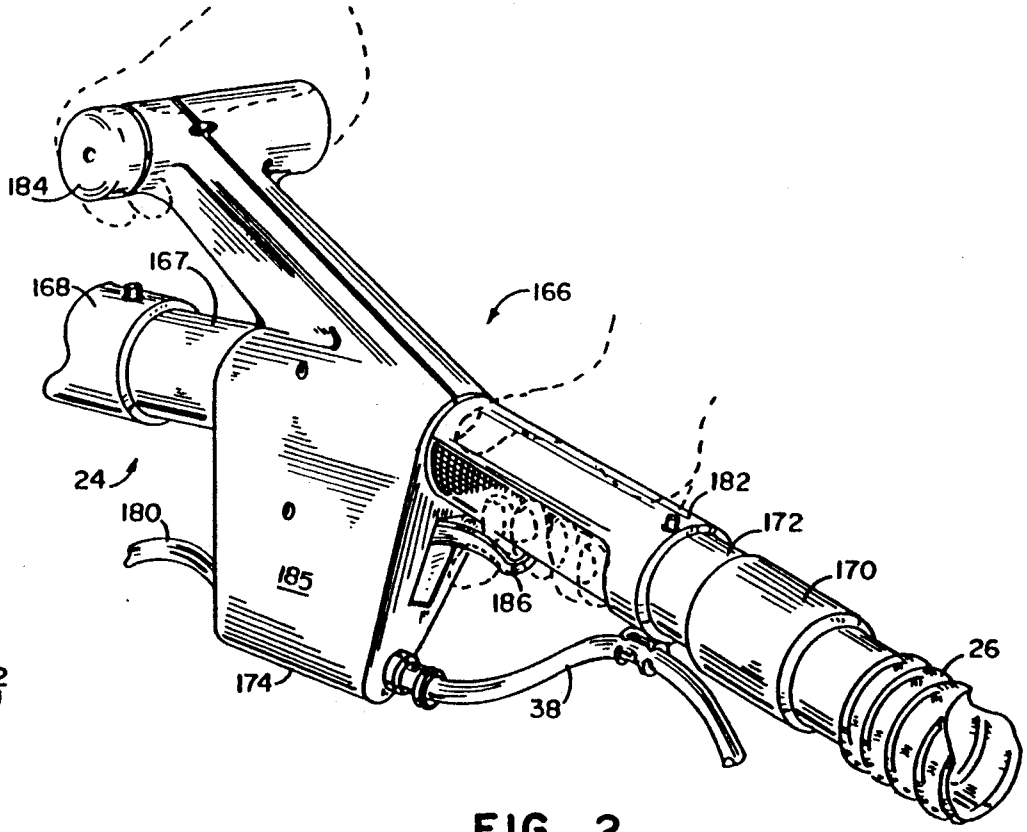
FIG. 2 is a perspective view of the handle portion of the wand assembly.
Figure 4:
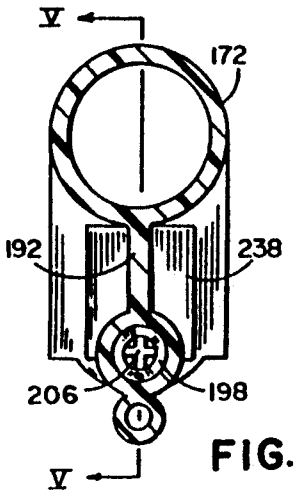
FIG. 4 is a sectional front elevational view along the lines 4—4 in FIG. 3.

Referring now to FIG. 2, wand assembly 24 is seen to have an operating handle member 166. A front connector 167 of handle 166 is connected to a rigid tube 168 that extends to suction nozzle 46. A connector 170 at the rear of handle 166 connects to suction hose 26. A hollow tube 172 extends through handle 166 between connectors 167 and 170. A control valve assembly 174 extends downwardly from handle 166 and has an affluent fitting 176 and an effluent fitting 178. Affluent fitting 176 connects to portion 38 of fluid hose 28. Effluent fitting 178 connects to a hose 180 extending to spray nozzle 42.

Handle 166 further has a first grip portion 182 and a second grip portion 184. A trigger 186 directly below grip portion 182 provides user actuation of control valve assembly 174, as will be described below. A cover 185 conceals most of the control valve assembly. Substantially all of the above components are formed from plastic material.

Figure 5:
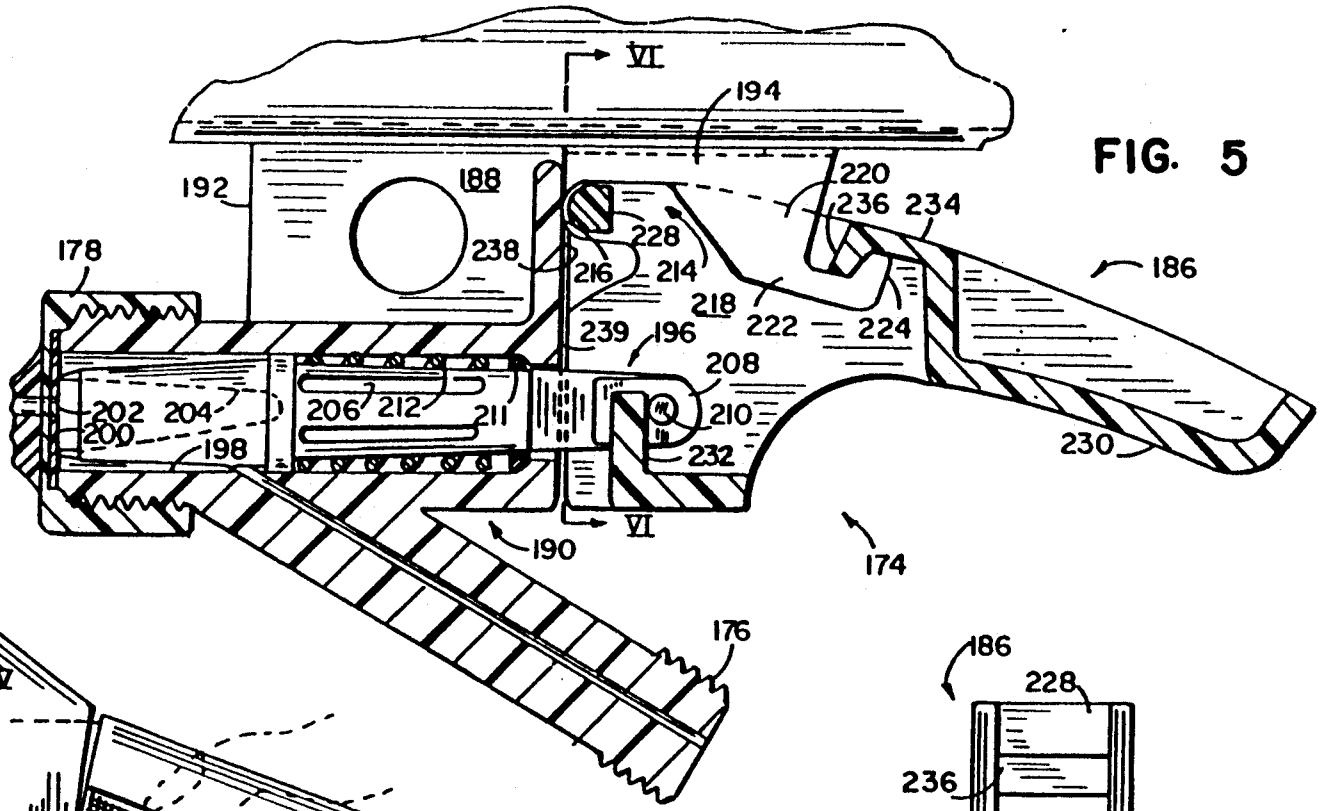
FIG. 5 is an enlarged sectional side elevational view along the lines 5—5 in FIG. 4.

Control valve 174 has a base 188 extending integrally from handle member 166 and a control valve 190 attached to a first portion 192 of base 188 (FIG. 5). Trigger 186 is attached to a second portion 194 of base 188, in a manner that will be explained, and is attached to valve member 190 by attachment means generally shown at 196.

Valve member 190 has a horizontal oriented barrel shown at 198 which is covered at one end by a resilient seat 200. Seat 200 has a passage 202 in its center for passage of fluid therethrough. A valve head 204 longitudinally reciprocates in barrel 198 between a first position contacting the seat 200, to close passage 202 to fluid flow, and a second position spaced from seat 200 to allow fluid flow through passage 202. An elongated stem 206 in barrel 198 has a first end portion attached to head 204 and a second end portion 208 Portion 208 is flattened and has a pair of studs 210 extending in opposite directions laterally therefrom. A spring 212 surrounds stem 206 and biases it towards the first, closed position. An 0-ring 211 surrounds stem 206 to prevent liquid from escaping between second end portion 208 and barrel 198.

Second portion 194 of base 188 has a generally horizontal throat 214 extending longitudinally away from the base first portion 192. Throat 214 has a rounded inner end portion 216 and a downwardly opening mouth portion 218. Second portion 194 further has a downwardly extending portion 220 that terminates in a flange 222 which, in turn, terminates in an upturned outer lip 224.

Figure 6:
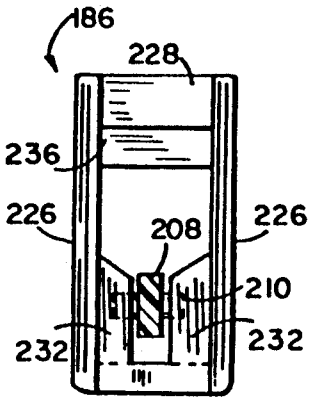
FIG. 6 is a sectional front elevational view along the lines 6—6 in FIG. 5.
Figure 3:
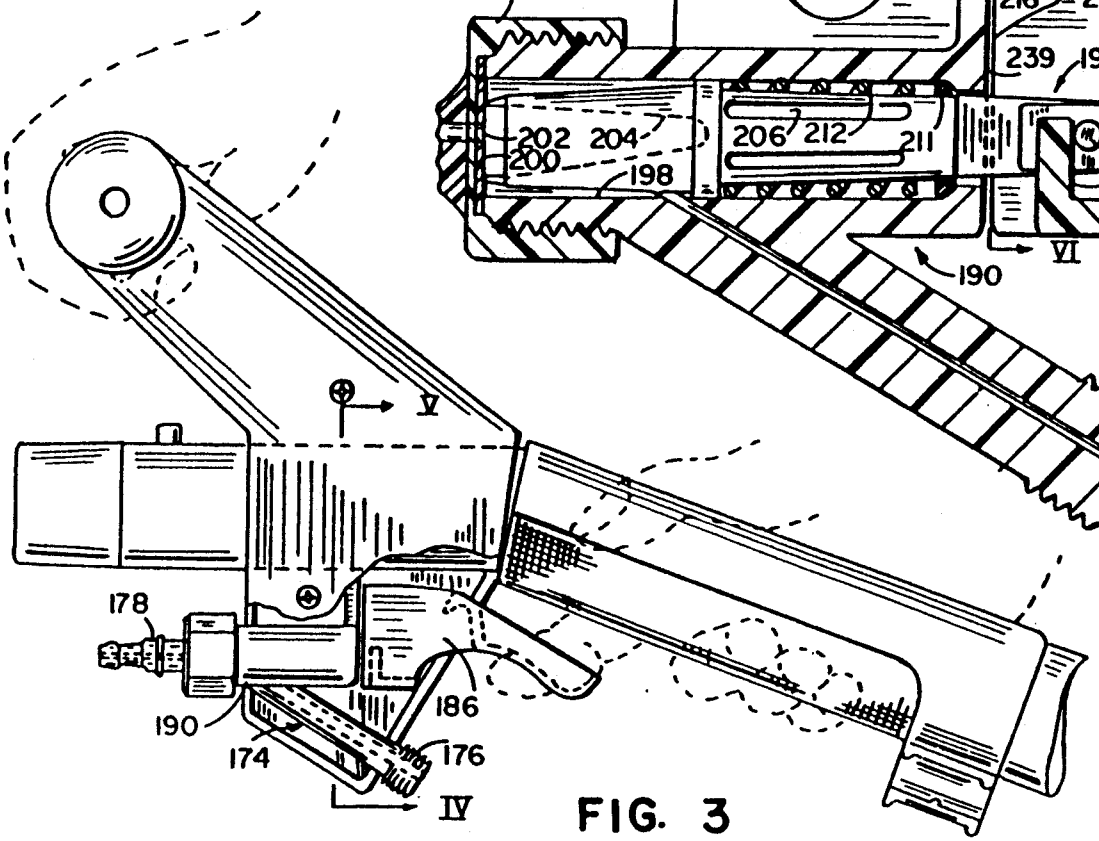
FIG. 3 is a side elevational view of the handle shown in FIG. 2 with a portion of the cover removed.

Trigger 186 has a pair of spaced apart parallel sidewalls 226 and a pin 228 and actuating portion 230 spanning the sidewalls 226 (FIG. 6). A pair of fingers 232 at a lower portion of trigger 186 are spaced apart the width of second end portion 208 of stem 206. Fingers 232 straddle end portion 208 and abut studs 210 to provide attachment means 196 with the valve member 190. Pin 228, which has an arcuate surface configured the same as inner end portion 216, is rotatable within throat 214. Actuating portion 230 terminates forwardly in a flange 234 which itself terminates in a downturned outer lip 236. Flange 234 and lip 236 overlap flange 222 and lip 224 on the base second portion. A member 238 defines a planar surface on first portion 192 that is adjacent to, and may abut, a planar surface 239 of trigger 186 when the trigger is not actuated.

In operation, an upward force on actuating portion 230 by a user's finger will cause trigger 186 to pivot about pin 228 rotating against inner end portion 216 of throat 214. Fingers 232-will move generally to the right, as viewed in FIG. 5, and in turn, contact studs 210 and move stem 206 to the right. This will cause head 204 to move from its first, closed position to its second, open position. Fluid entering affluent fitting 176 will flow through barrel 198 and through passage 202 out effluent fitting 178. When the user releases the grip on actuating portion 230, the biasing force of spring 212 will move the valve to the closed position and rotate the trigger clockwise, as viewed in FIG. 5. The interaction of overlapping flanges 222, 234 and lips 224, 236, along with attachment means 196 and pin 228 in throat 218, prevents the trigger from coming loose or disassembled from portion 194.

The above-described control valve assembly, with the exception of spring 212 is entirely molded from plastic materials and hence is inexpensive to manufacture. In addition, the valve assembly can be assembled without the use of separate fasteners and results in a securely assembled, smoothly operating mechanism.

Assembly of control valve 174 is as follows. Spring 212 is placed over stem 206 and the stem is placed in the barrel 198 from the left, as viewed in FIG. 5. An object such as a dowel is used to exert a force against head 204 in order to compress the spring 212. With spring 212 compressed, pin 228 is positioned in throat 214 through mouth portion 218. Simultaneously, downturned lip 236 on the trigger is moved up and over upturned lip 224 of portion 220. Also, simultaneously, fingers 232 are slid to the left of studs 210 into their straddling relationship with end portion 208. The pressure exerted by the dowel is then released. Spring 212 will force the stem and head of the valve to the left, to their first position This biasing force will hold pin 228 securely within throat 214 and will keep lips 234 and 236 in their overlapping interlocked orientation. Finally, effluent fitting 178 having seat 200 inserted therein, is threaded onto threads of valve member 190 and into contact with head 204.

To disassemble the control valve assembly these steps are repeated in the reverse order. While the assembly of the valve is simple and straightforward, the final assembly will be stable and not subject to coming apart unless fitting 178 is removed and an instrument is used to compress spring 212.

Of course, it is understood that the above is merely a preferred embodiment of the invention. Changes and modifications in the specifically described embodiments can be carried out without departing from the scope of the invention, which is intended to be limited only by the scope of the appended claims and all equivalents to which we are entitled as a matter of law.

The embodiments of the invention in which an exclusive property or privilege is claimed are defined as follows.

1. A fluid flow control means comprising:

a base, a valve member, a trigger member and attachment means for attaching said trigger member to said valve member;

said base comprising a first portion rigidly attached to said valve member and a second portion adjacent said first portion, said second portion having surface means defining a generally horizontal throat extending in a first direction away from said first portion to an open mouth located away from said first portion, said surface means having a first upwardly extending latching flange;

said valve member comprising a housing and a stem longitudinally movable in said housing between a first position and a second position, means biasing said stem toward said first position in a direction generally opposite said first direction, said biasing means being operably connected to said attachment means to bias said trigger into position toward said first portion of said base; and establishing means associated with said stem for establishing no liquid flow when said stem is in said first position and for establishing maximum liquid flow when said stem is in said position; and said trigger member comprising a laterally extending pin loosely disposed in a portion of said throat defined by said surface means, a second latching flange on said trigger member having a generally downwardly facing surface overlapping said upwardly extending latching flange on said surface means to maintain said pin in said throat portion defined by said surface means when said trigger member is not actuated and preventing said trigger member from coming loose or disassembled from said surface means when said trigger member is actuated and second latching flange disengages from said first latching flange on said surface means while permitting said pin to move loosely in said throat portion defined by said surface means.

2. The apparatus in claim 1 wherein said first flange terminates in an upturned outer lip and said second flange terminates in a down turned outer lip overlapping said upturned outer lip.

3. The apparatus in claim 2 wherein said attachment means comprises a pair of oppositely extending studs on said valve stem and a pair of spaced apart fingers on said trigger member straddling said valve stem and engaging said studs.

4. The apparatus in claim 3 further having a first generally planar surface on said base first portion transverse said valve stem and a second generally planar surface on said trigger member generally abutting said first planar surface when said valve stem is in said first position.

5. The apparatus in claim 4 wherein said pin and said throat end portion have generally conforming curved surfaces.

6. The apparatus of claim 1, wherein:

said trigger member comprises a laterally extending pin located in said throat, and an actuating portion extending in said first direction away from said pin, said biasing means of said valve member also biasing said pin into said throat through its biasing action on said trigger.

7. The apparatus in claim 6 wherein said attachment means comprises a pair of oppositely extending studs on said valve stem and a pair of spaced apart fingers on said trigger member straddling said valve stem and engaging said studs.

8. The apparatus in claim 6 further having a first generally planar surface on said base first portion transverse said valve stem and a second generally planar surface on said trigger member generally abutting said first planar surface when said valve stem is in said first position.

* * * * *

UNITED STATES PATENT AND TRADEMARK OFFICE

CERTIFICATE OF CORRECTION

PATENT NO. : 5,087,018

DATED : February 11, 1992

INVENTOR(S) : Michael R. Blase et al.

It is certified that error appears in the above-identified patent and that said Letters Patent is hereby corrected as shown below:

Column 3, line 65:
After "portion 208" insert --.--.

Column 5, claim 1, line 42:
After "said" insert --second--.

Column 6, claim 8, line 41:
"Claim 6" should be --Claim 7--.

Signed and Sealed this

Seventeenth Day of August, 1993

Bruce Lehman

*Attest:*

BRUCE LEHMAN

*Attesting Officer*

*Commissioner of Patents and Trademarks*